US005809616A

United States Patent [19]

Porter, Sr.

[11] Patent Number: 5,809,616

[45] Date of Patent: Sep. 22, 1998

[54] SHIPPING CASE HANDLE

[75] Inventor: Gerry R. Porter, Sr., Cincinnati, Ohio

[73] Assignee: Clipper Products, Cincinnati, Ohio

[21] Appl. No.: 738,893

[22] Filed: Oct. 28, 1996

[51] Int. Cl.[6] ..... A47B 95/02

[52] U.S. Cl. ..... 16/115; 190/115

[58] Field of Search ..... 16/115; 190/18 A, 190/39, 115, 116, 117, 18 R; 280/47.31, 655, 655.1, 63, 37

[56] References Cited

U.S. PATENT DOCUMENTS

| | | | |
|---|---|---|---|
| 5,335,759 | 8/1994 | Yeh | 190/115 |
| 5,447,217 | 9/1995 | Chou | 190/115 |
| 5,526,908 | 6/1996 | Wang | 190/115 |
| 5,533,601 | 7/1996 | Wang | 190/115 |
| 5,566,798 | 10/1996 | Tsai | 190/115 |
| 5,639,109 | 6/1997 | Liang | 280/655.1 |
| 5,706,921 | 1/1998 | Wang | 16/115 |

*Primary Examiner*—Chuck Mah
*Attorney, Agent, or Firm*—Donald J. Ersler

[57] ABSTRACT

A shipping case transport system includes a pair of corner mounted castors and a flush mounted handle. The corner mounted castor comprises a wheel housing, a wheel, and an axle. The wheel fits into a recess and an axle is inserted through the housing and wheel to the retain the wheel in rotable relationship to the wheel housing. A flange extends outward from one end of the wheel housing and a plurality of fastening holes are formed in periphery thereof. The flush mounted handle comprises a flange, a first tube retainer, a second tube retainer, a handle, and a locking mechanism. A recessed area is formed in the top of the flange. The handle has an elongated U-shape, with a first and second leg. A first and second hole is formed in the flange of the handle. A first and second tube retainer securely holds the first and second legs of the handle, respectively. The locking mechanism comprises a release button, a locking finger and a pivot arm. Depressing the release button causes the pivot arm to swing the locking finger from a hole in the second leg, and allows the user to move the handle to a retracted or extended position. Installation of the flush mounted handle and the corner mounted castors is accomplished by cutting a rectangular opening in the bottom front edge and trapezium openings in the rear bottom corners of the shipping case, respectively. The fastening holes in the flush mounted handle and the corner mounted castors are used as drilling template. The flush mounted handle and corner mounted castors are attached with any suitable fasten means.

10 Claims, 10 Drawing Sheets

SHIPPING CASE HANDLE

BACKGROUND OF THE INVENTION

1. Field of the Invention

The present invention relates generally to the transportation of shipping cases and more specifically to a shipping case transport system which is adaptable to the flush mount requirements of some shipping cases and which protects the shipping case better than that of the prior art.

2. Discussion of the Prior Art

There are at least two prior art methods of transporting large shipping cases. The first method uses four detachable castors which are fastened to the bottom of the shipping case. The shipping case is moved when the shipping clerk bends over and pushes the shipping case. Four sliding plates are fastened to the bottom of the shipping case and the four castors are slid into the four sliding plates. The problem with this method is that the shipping clerk has to remove the four castors and put them in a bag. The castors can be lost, sometimes a shipping clerk will forgot to remove the castors and they will become damaged. The shipping clerk must also bend over and push the shipping case which exposes the shipping clerk to the likelihood of back injuries.

The second method requires the placement of two corner mounted castors on two corners of the shipping case and attaching a handle on the end opposite the corner mounted castors. The shipping clerk pulls the shipping case with the handle. Two corners of the shipping case are cut away and an opening is cut in the opposite end for the handle. This method works better, but the prior art corner castors and handles have drawbacks. There is a drawback in the design of the prior art corner castors, because the open design of the prior art corner castors allows water to enter the shipping case. The water can damage the shipping case and the contents thereof. The prior art corner castor is also not a single integrated piece. The lack of structural rigidity in the prior art castor puts stress on the corners of the shipping case, thus increasing the probability of damage to the shipping case during transit.

The non-flush mounted handle can be easily damaged during shipping, because it protrudes outward from the end of the case. The non-flush handle also does not have a provision for locking the pull handle into a retracted position. Secondly, the installation of the non-flush mounted handle is very complicated. A number of large holes must be drilled in the case and numerous pieces of hardware must be mounted to the case before the non-flush mounted handle may be attached.

Accordingly, there is a clearly felt need in the art for a shipping case transport system which has a flush mounted handle that may be locked into place, a flush mounted handle that may be easily mounted to a case, and a corner mounted castor which is stronger than the prior art design and that does not allow water to enter the shipping case.

SUMMARY OF THE INVENTION

The primary objective of the present invention is to provide a shipping case transport system which has a flush mounted handle that may be locked into place, a flush mounted handle that may be easily mounted to a case, and a corner mounted castor which is stronger than the prior art design and that does not allow water to enter the shipping case.

According to the present invention, a shipping case transport system includes a pair of corner mounted castors and a flush mounted handle. The corner mounted castor comprises a wheel housing, a wheel, and an axle. The wheel housing has a first end, a second end, a bottom side and a rear side. A recess is formed between the first and second ends of the wheel housing. The recess is sized to slidably receive the width of the wheel and provide clearance for the diameter of the wheel. A first bore is formed through the first end of the wheel housing at a first corner and a second bore is formed through the second end of the wheel housing at the first corner. An axle is inserted through the first bore and the second bore of the wheel housing to retain the wheel in a rotable relationship with the housing. A first flange extends outward from the bottom side of the wheel housing. A second flange extends outward from the rear side of the wheel housing. A plurality of fastening holes are formed in the peripheries of the first flange, the second flange, the rear side and the first end of the wheel housing.

The flush mounted handle comprises a flange, a pair of tube retainers, a handle, and a locking mechanism. The flange has a front surface, a top surface, and a recessed area. The front surface is perpendicular to the top surface and the recessed area is formed in substantially the center of the flange at the corner of the top and front surfaces. The recessed area has a bottom surface, a front surface, a first end, and a second end. A first hole is formed in the bottom surface of the recessed area at substantially the first end. A second hole is formed in the bottom surface of the recessed area at substantially the second end. A plurality of fastening holes are formed in the periphery of the top and front surfaces of the flange.

The handle is fabricated from a tube and is formed into an elongated U-shape. The handle has a first leg, a second leg, and a handle portion. The first tube retainer has a first end and a second end. A mounting surface is formed at substantially the second end of the first tube retainer. The first tube retainer is mounted to the opposite side of the front surface of the flange, such that an inner diameter of the first tube retainer is concentric with the first hole of the flange. The second tube retainer has a first end, and a second end. A mounting surface is formed at substantially the second end of the second tube retainer. The second tube retainer is mounted to the opposite side of the front surface of the flange such that an inner diameter of the second tube retainer is concentric with the second hole of the flange. The first hole, the second hole and the inner tube diameter of the first and second tube retainers are sized to slidably receive the outer diameter of the first and second legs of the handle, respectively.

The locking mechanism comprises a release button, a locking arm, and a spring. The release button protrudes from the bottom surface of the recessed area and is disposed between the first and second legs of the handle. The locking arm has a pivot arm, a locking finger, and a spring arm. The pivot arm is pivotally connected to the front surface of the flange. The locking finger is sized to be inserted into a retraction hole and an extension hole formed in the second leg. The spring retains the locking finger in the retraction hole or extension hole in the second leg. The release button is depressed to remove the locking finger from either hole in the second leg and allow the handle to be retracted or extended. A locking pin is inserted into an end of the first and second legs to prevent the handle from being pulled completely out of the flange.

Installation of the flush mounted handle and the corner mounted castors is quick and easy. A trapezium opening is cut into the two rear bottom corners of a shipping case to provide clearance for the corner mounted castors. A rectangular opening is cut in the bottom front edge of the shipping case to provide clearance for the flush mounted handle.

The corner mounted castors are placed on the rear bottom corners of the shipping case, and the fastening holes of the corner mounted castors are used as a template for drilling holes in the shipping case. After the holes have been drilled, the corner mounted castors can be fastened to the shipping case with pop rivets, wood screws or other suitable fastening means.

The flush mounted handle is placed in the bottom front edge of the shipping case, and the fastening holes of the flush mounted handle are used as a template for drilling holes in the shipping case. After the holes have been drilled, the flush mounted handle can be fastened to the shipping case as a single module with pop rivets, wood screws, or other suitable fastening means.

Accordingly, it is an object of the present invention to provide a shipping case transport system which has a flush mounted handle.

It is a further object of the present invention to provide a shipping case transport system which has a handle that can be locked into a retracted or extended position.

It is yet a further object of the present invention to provide a shipping case transport system which has a corner mounted castor that does not allow water to enter the shipping case and damage the contents thereof.

It is yet a further object of the present invention to provide a shipping case transport system which has a flush mounted handle which may be easily mounted to a shipping case.

Finally, it is another object of the present invention to provide a shipping case transport system which has a corner mounted castor of superior design that does not put stress on the corner of a shipper case.

These and additional objects, advantages, features and benefits of the present invention will become apparent from the following specification.

DETAILED DESCRIPTION OF THE PREFERRED EMBODIMENTS

Figure 1:
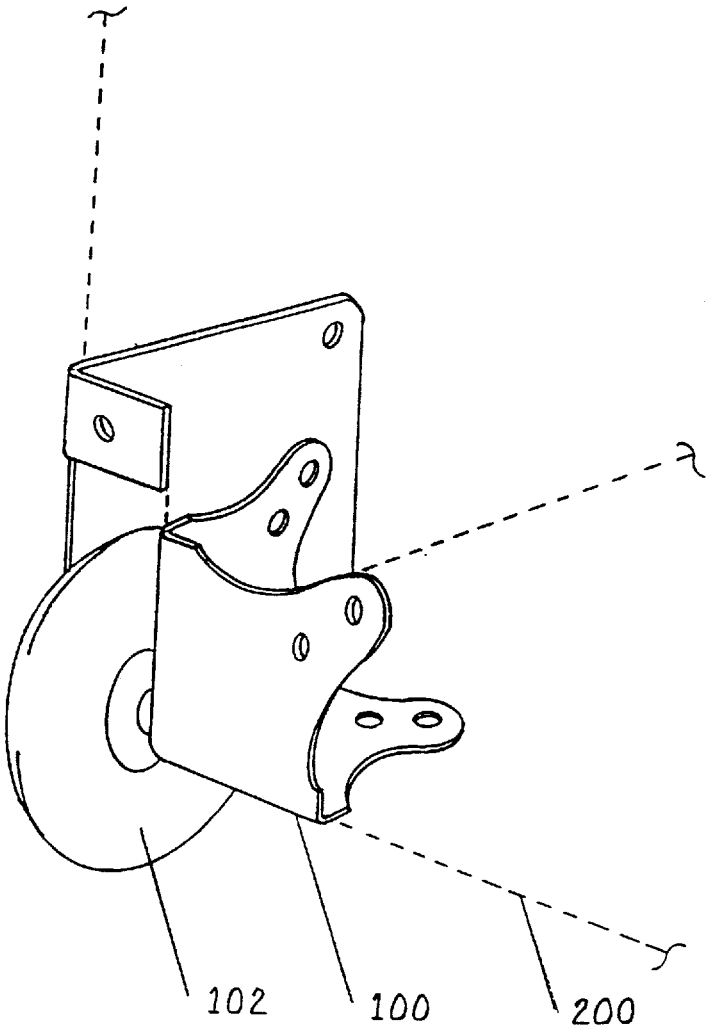
FIG. 1 (PRIOR ART)
FIG. 1 is a perspective rear detail view of a prior art corner castor fastened to a shipping case.

With reference now to the drawings, and particularly to FIG. 1, there is shown a perspective rear detail view of a prior art corner castor 100 fastened to a shipping case 200. If the wheel 102 is transported through a puddle of water, the water will spray inside the shipping case 200. This may damage the contents of the shipping case 200.

Figure 2A:
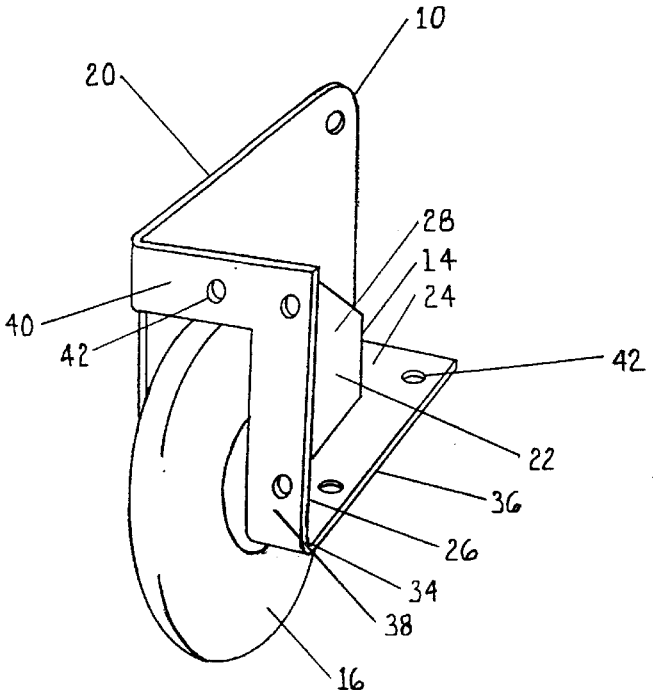
FIG. 2*a* is a perspective rear detail view of a corner mounted castor in accordance with the present invention.
Figure 2B:
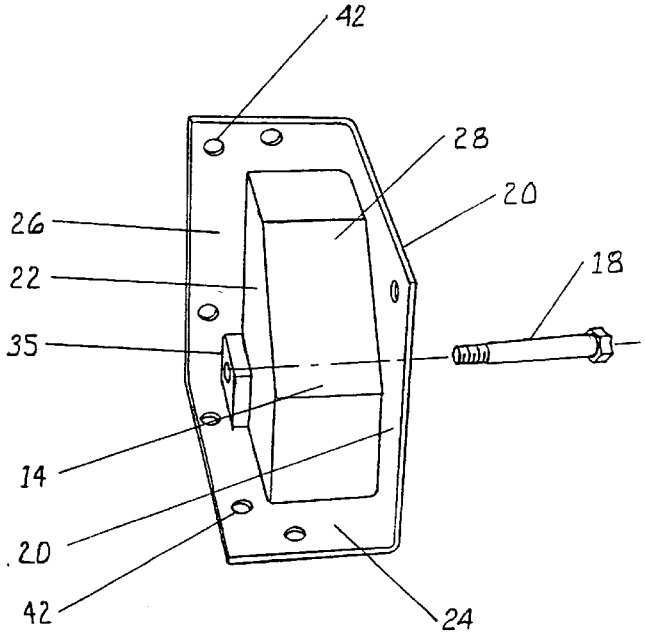
FIG. 2*b* is a perspective exploded view of a corner mounted castor in accordance with the present invention.
Figure 3:
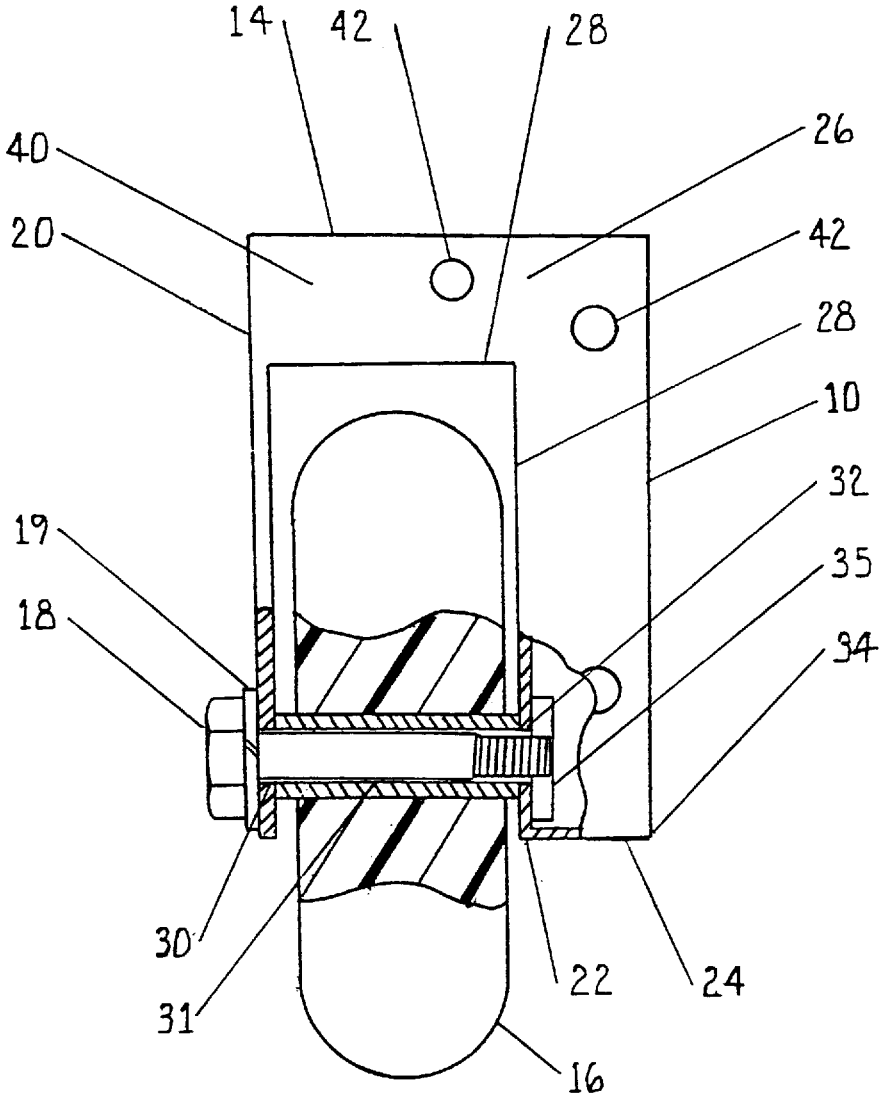
FIG. 3 is a cutaway rear detail view of a corner mounted castor in accordance with the present invention.

FIG. 2*a* and 2*b* show a perspective view of a corner mounted castor 10. With reference to FIG. 3, the corner mounted castor 10 comprises a wheel housing 14, a wheel 16, and an axle 18. The wheel housing 14 has a first end 20, a second end 22, a bottom side 24, and a rear side 26. A recess 28 is formed between the first end 20 and the second end 22 of the wheel housing 14. The recess 28 is sized to slidably receive the width of the wheel 16 and provide clearance for the diameter thereof. A first bore 30 is formed through the first end 20 of the wheel housing 14 at a first corner 34. A second bore 32 is formed through the second end 22 of the wheel housing 14 at the first corner 34. An axle 18 is inserted through the first bore 30, second bore 32, and wheel bore 31 to retain the wheel 16 in a rotable relationship with the wheel housing 14. It has been found that a hex bolt forms a satisfactory axle 18, when used with a lock washer 19 and retained by a weld nut 35. The axle 18 could also be a groove pin with a retaining clip.

A first flange 36 extends outward from the bottom side 24 of the wheel housing 14. A second flange 38 extends outward from the rear side 26 of the wheel housing 14. A plurality of fastening holes 42 are formed in the peripheries of the first flange 36, the second flange 38, the rear side 26, and the first end 20. The wheel housing 14 of the corner mounted castor 10 may be fabricated from a casting or from two pieces of sheet metal.

Figure 4:
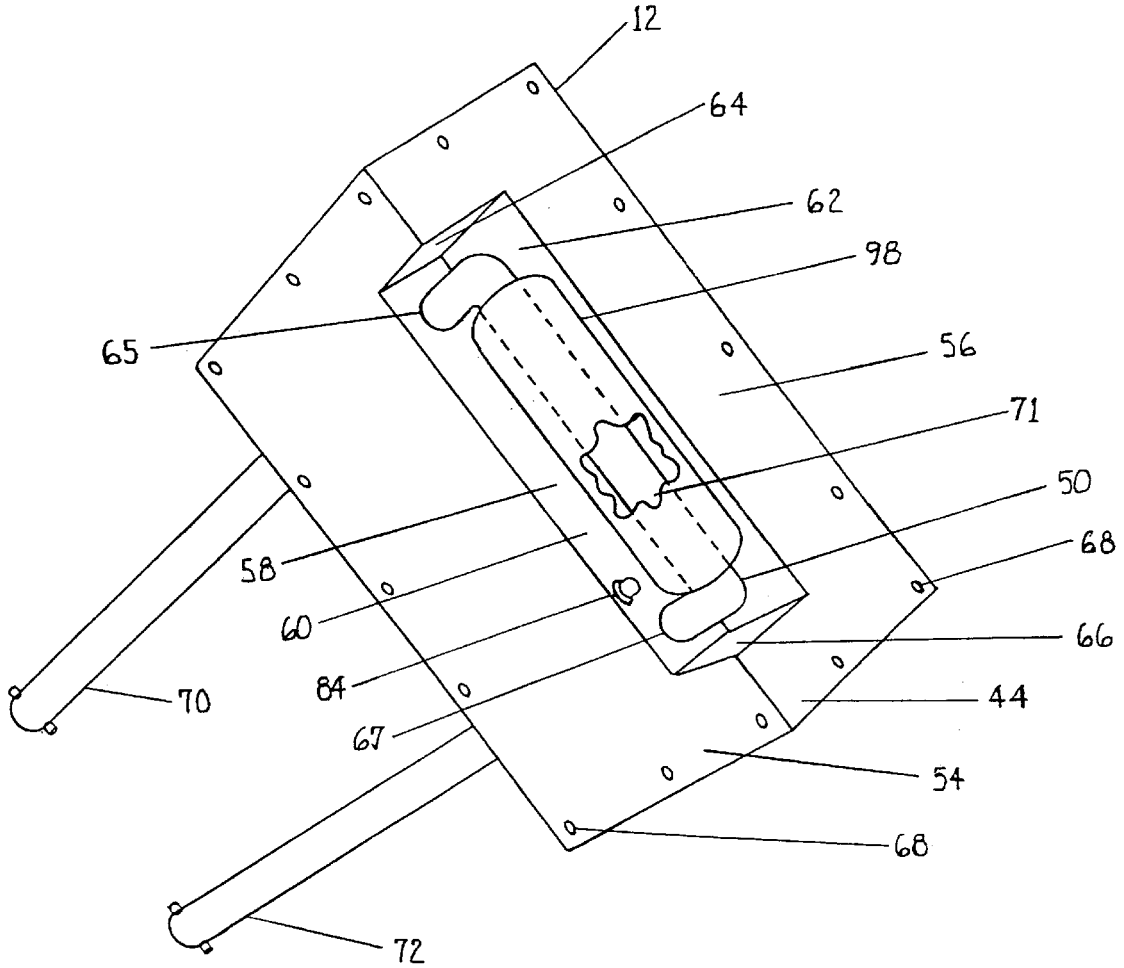
FIG. 4 is a perspective detail view of a flush mounted handle in accordance with the present invention.
Figure 5:
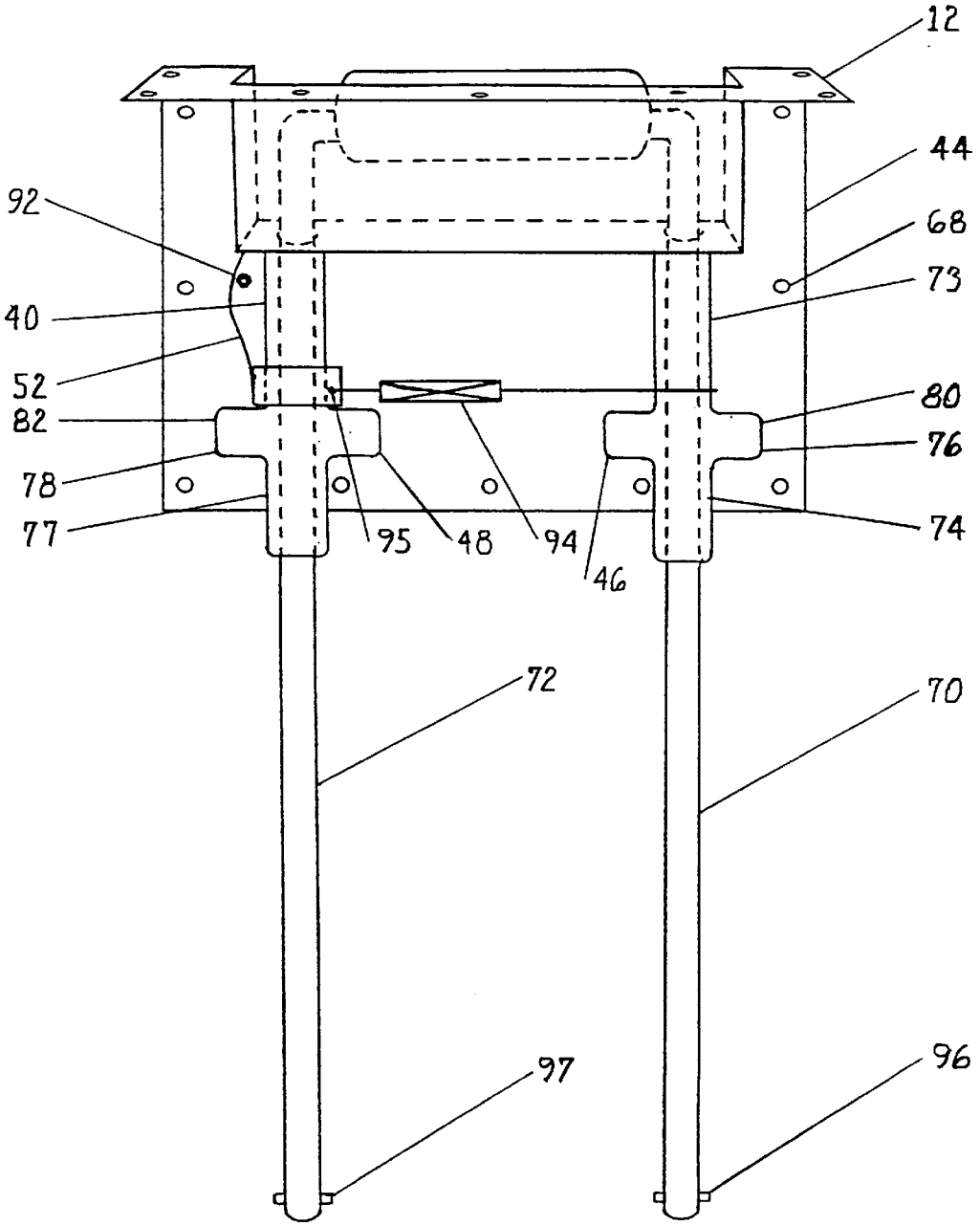
FIG. 5 is a perspective detail view of a flush mounted handle in accordance with the present invention.
Figure 6:
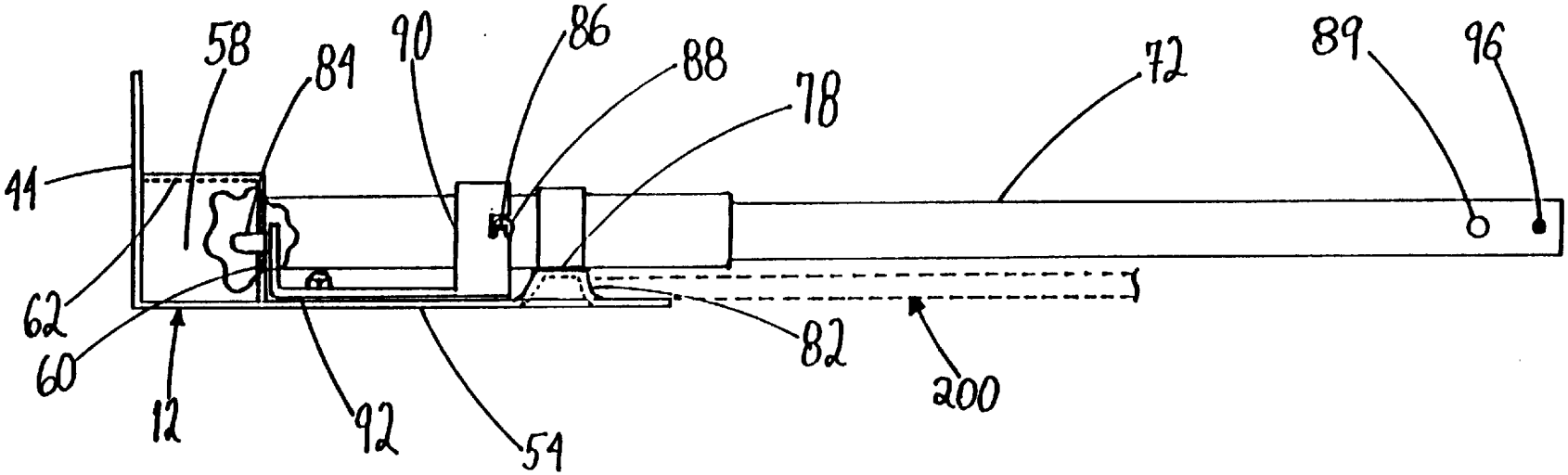
FIG. 6 is a side detail view of a flush mounted handle in accordance with the present invention.

FIG. 4 shows a perspective detail view of a flush mounted handle 12 in a retracted position. With reference to FIGS. 5 and 6, the flush mounted handle 12 comprises a flange 44, a first tube retainer 46, a second tube retainer 48, a handle 50, and a locking mechanism 52. The flange 44 has a front surface 54, a top surface 56, and a recessed area 58. The front surface 54 is perpendicular to the top surface 56 and the recessed area 58 is formed in the flange 44 at the corner of the top surface 56 and front surface 54. The recessed area 58 has a bottom surface 60, a front surface 62, a first end 64, and a second end 66. A first hole 65 is formed in the bottom surface 60 of the recessed area 58 at substantially the first end 64. A second hole 67 is formed in the bottom surface 60 of the recessed area 58 at substantially the second end 66. A plurality of fastening holes 68 are formed in the periphery of the top surface 56 and front surface 54 of the flange The handle 50 is fabricated from a tube and is formed into an elongated U-shape. The handle 50 has a first leg 70, a second leg 72, and a handle portion 71. A first tube retainer 46 has a first end 73 and a second end 74. A mounting surface 76 is formed at substantially the second end 74 of the first tube retainer 46. The first tube retainer 46 is mounted to a first mounting projection 80 on the opposite side of the front surface 54, such that an inner diameter of the first tube retainer 46 is concentric with the first hole 65 of the flange 44. The second tube retainer 48 has a first end 75, and a second end 77. A mounting surface 78 is formed at substantially the second end 77 of the second tube retainer 48. The second tube retainer 48 is mounted to a second mounting projection 82 in the opposite side of the front surface 56, such that an inner diameter second tube retainer 48 is concentric with the second hole 67 of the flange 44. The height of mounting projection 82 and mounting projection 80 provide clearance for the wall thickness of the shipping case 200. The first hole 65, and the inner diameter of the first tube retainer 46 are sized to slidably receive the outer diameter of the first leg 70. The second hole 67, and the inner diameter of the second tube retainer 48 are sized to slidably receive the outer diameter of the second leg 72.

Figure 7:
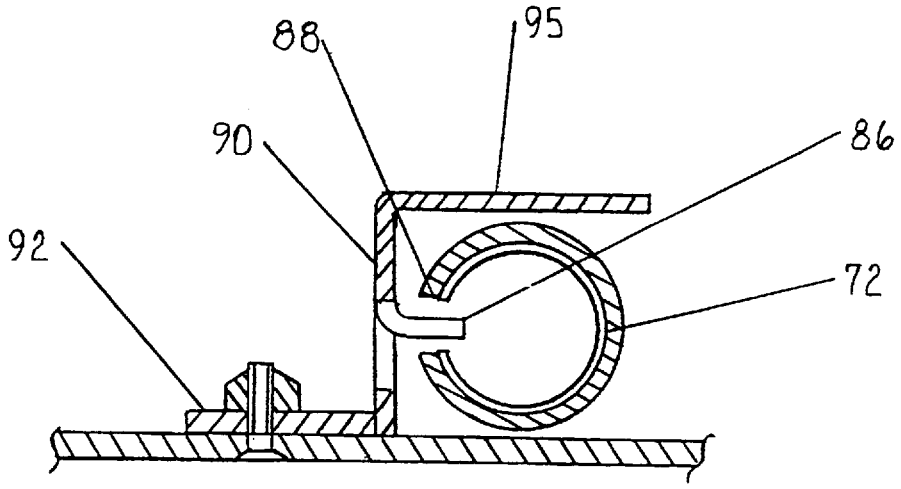
FIG. 7 is a cross sectional detail view of a locking finger of a locking mechanism inserted into a retraction hole in a second leg of a handle in accordance with the present invention.

FIG. 7 shows a cross sectional detail view of a locking finger 86 of the locking mechanism 52 inserted into a retraction hole 88 in the second leg 72. With reference to FIGS. 4, 5 and 6, the locking mechanism 52 comprises a release button 84, a locking arm 90, and a spring 94. The release button 84 protrudes from the bottom surface 60 of the recessed area 58 and is disposed between the first hole 65 and second hole 67. The locking arm 90 has a pivot arm 92, a spring arm 95, and the locking finger 86. The pivot arm 92 is pivotally connected to the front surface 54 of the flange 44. The locking finger 86 is sized to be inserted into the retraction hole 88 and an extension hole 89 formed in the second leg 72. One end of the spring 94 is hooked around the first leg tube retainer 46 and the other end is fastened to the spring arm 95. The spring 94 retains the locking finger 86 in the retraction hole 88 or the extension hole 89. The release button 84 is depressed to extract the locking finger 86 from either the retraction hole 88 or the extension hole 89 in the second leg 72. Extraction of the locking finger 86 allows the handle to be moved to a retracted or extended position. A first locking pin 96 is pressed into the end of the first leg 70 and a second locking pin 97 is pressed into the end of the second leg 72 to prevent the handle 50 from being pulled completely out of the flange 44. A hand saver 98 maybe slipped over the handle portion 71 to prevent chaffing of a hand while pulling a shipping case. The hand saver 98 can be fabricated from a soft rubber material.

Figure 8:
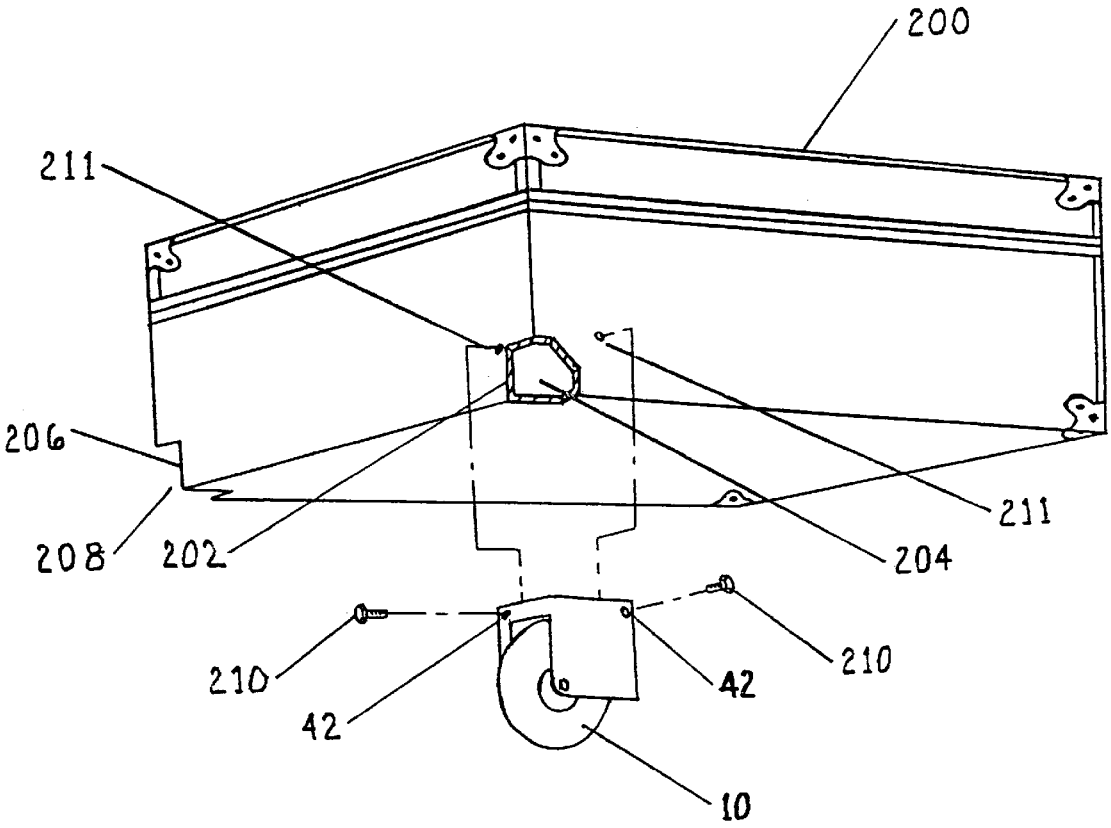
FIG. 8 is a perspective exploded view of a shipping container with a trapezium opening for a corner mounted castor in accordance with the present invention.

FIG. 8 shows a perspective exploded view of a shipping container 200 with a trapezium opening 202 for a corner mounted castor 10. A first trapezium opening 202 is cut in a first rear bottom corner 204 of the shipping case 200 to provide clearance for the corner mounted castor 10. A second trapezium opening 206 is cut in a second rear bottom corner 208 of the shipping case 200. The corner mounted castor 10 is placed on the corner of the shipping case 200, and the fastening holes 42 in the corner mounted castor 10 are used as a template for drilling holes in the shipping case. After the fastening holes 211 have been drilled, the corner mounted castor 10 can be fastened to the shipping case 200 with pop rivets, wood screws or other suitable fastening means 210.

Figure 9:
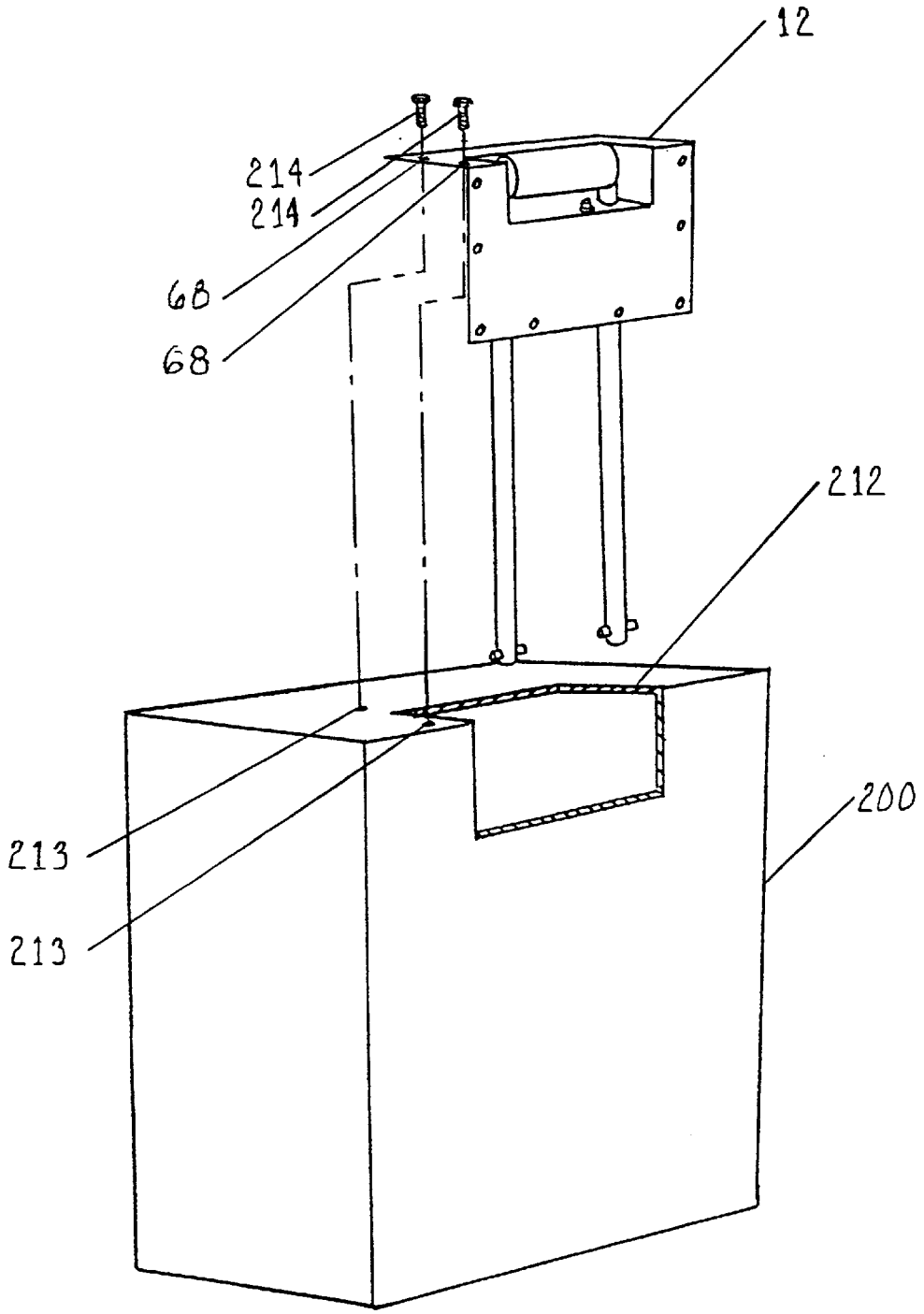
FIG. 9 is a perspective exploded view of a shipping container with a rectangular opening for a flush mounted handle in accordance with the present invention.

FIG. 9 shows a perspective exploded view of a shipping container 200 with a rectangular opening 212 for a flush mounted handle 12. The rectangular opening 212 is cut in the bottom front edge of the shipping case 200. The fastening holes 68 of the flush mounted handle 12 are used as a template for drilling holes in the shipping case 200. After the fastening holes 213 have been drilled, the flush mounted handle 12 can be fastened to the shipping case 200 with pop rivets, wood screws or other suitable fastening means 214.

Figure 10:
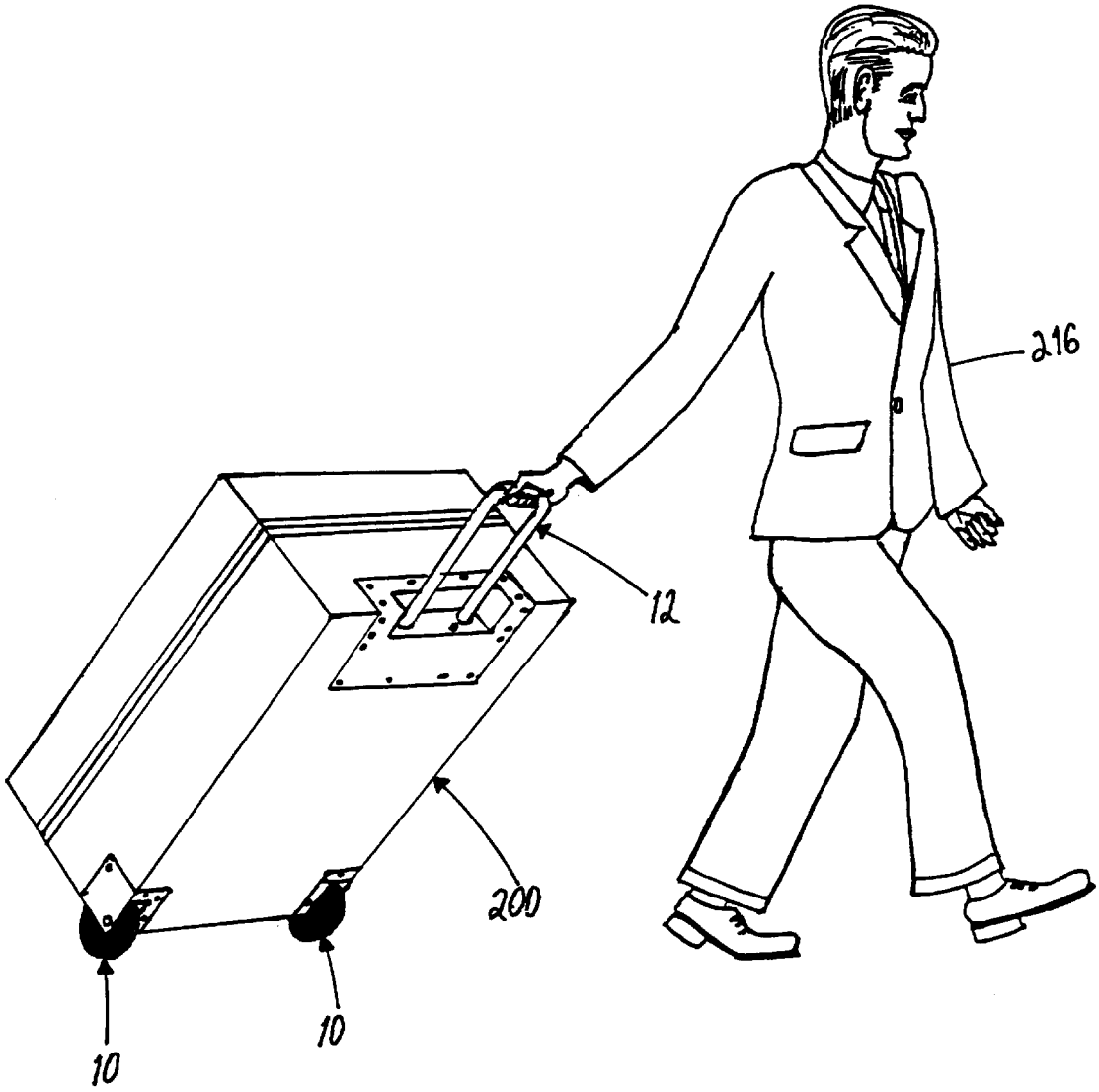
FIG. 10 is a perspective view of a shipping clerk transporting a shipping case with a shipping case transport system in accordance with the present invention.

FIG. 10 shows a perspective view of a shipping clerk 216 transporting a shipping case 200 with a shipping case transport system 1. The shipping clerk 216 pulls a shipping case 200 with the help of a flush mounted handle 12 in the extension position and a pair of corner mounted castors 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A flush mounted handle comprising:

a flange having a front surface, a top surface and a recessed area, said front surface being substantially perpendicular to said top surface, said recessed area being formed at the corner of said top surface and said front surface, a first hole being formed at one end of said recessed area, a second hole being formed at the other end of said recessed area;

a handle having a first leg, a second leg, and a handle portion, a retraction hole and an extension hole being formed in one of said legs, said first leg being inserted through said first hole, said second leg being inserted through said second hole;

a locking arm being pivotally connected to said flange, a locking finger extending from said locking arm, said locking finger fitting into said retraction hole;

a release button disposed in said recessed area, said release button being in contact with said locking arm, wherein said locking finger being retained in said retraction hole by a spring when said handle is in a retracted position, said locking finger being held in said extension hole by said spring when said handle is in an extended position, said locking finger being withdrawn from said retraction hole or said extension hole when said release button is depressed.

2. The flush mounted handle of claim 1, further comprising:

said first leg having a first locking pin inserted at a bottom end thereof to prevent said handle from being withdrawn from said flange.

3. The flush mounted handle of claim 1, further comprising:

said second leg having a second locking pin inserted at a bottom end thereof to prevent said handle from being withdrawn from said flange.

4. The flush mounted handle of claim 1, further comprising:

a plurality of holes being formed in said flange for mounting thereof to a case.

5. The flush mounted handle of claim l, further comprising:

a first tube retainer being mounted to said flange, wherein an inner diameter of said first tube retainer being concentric with said first hole in said flange, said first leg of said handle being slidably received by said first hole and said inner diameter of said first tube retainer.

6. The flush mounted handle of claim 1, further comprising:

a second tube retainer being mounted to said flange, wherein an inner diameter of said second tube retainer being concentric with said second hole in said flange, said second leg of said handle being slidably received by said second hole and said inner diameter of said second tube retainer.

7. A flush mounted handle comprising:

a flange having a front surface and a recessed area, said front surface being substantially perpendicular to said top surface, a first hole being formed at one end of said recessed area, a second hole being formed at the other end of said recessed area;

a handle having a first leg, a second leg, and a handle portion, a retraction hole being formed in one of said legs, said first leg being inserted through said first hole, said second leg being inserted through said second hole;

a first tube retainer being mounted to said flange, wherein an inner diameter of said first tube retainer being concentric with said first hole in said flange, said first leg of said handle being slidably received by said first hole and said inner diameter of said first tube retainer;

a second tube retainer being mounted to said flange, wherein an inner diameter of said second tube retainer being concentric with said second hole in said flange, said second leg of said handle being slidably received by said second hole and said inner diameter of said second tube retainer;

a locking arm being pivotally connected to said flange, a locking finger extending from said locking arm, said locking finger fitting into said retraction hole; and a release button disposed in said recessed area, said release button being in contact with said locking arm, wherein said locking finger being retained in said retraction hole by a spring when said handle is in a retracted position, said locking finger being held in an extension hole by said spring when said handle is in an extended position, said locking finger being withdrawn from said retraction hole or said extension hole when said release button is depressed.

8. The flush mounted handle of claim 7, further comprising:

said first leg having a first locking pin inserted at a bottom end thereof to prevent said handle from being withdrawn form said flange.

9. The flush mounted handle of claim 7, further comprising:

said second leg having a second locking pin inserted at a bottom end thereof to prevent said handle from being withdrawn form said flange.

10. The flush mounted handle of claim 7, further comprising:

a plurality of holes being formed in said flange for mounting thereof to a case.

* * * * *

UNITED STATES PATENT AND TRADEMARK OFFICE

CERTIFICATE OF CORRECTION

PATENT NO. : 5,809,616
DATED : September 22, 1998
INVENTOR(S) : Gerry R. Porter SR.

It is certified that error appears in the above-identified patent and that said Letters Patent is hereby corrected as shown below:

Figure 2a: remove item "40" and leader line

Figure 3: remove item "40" and leader line

Figure 5: cancel "40" and insert "75"

Col. 4, line 65: cancel "56" and insert "54"

Signed and Sealed this

Sixteenth Day of March, 1999

*Attest:*

Q. TODD DICKINSON

*Attesting Officer*

*Acting Commissioner of Patents and Trademarks*